US012031246B2

(12) United States Patent
Tuominen

(10) Patent No.: US 12,031,246 B2
(45) Date of Patent: Jul. 9, 2024

(54) FABRIC

(71) Applicant: Oy Sda Finland Ltd, Vantaa (FI)

(72) Inventor: Vesa Tuominen, Vantaa (FI)

(73) Assignee: OY SDA FINLAND LTD, Vantaa (FI)

( * ) Notice: Subject to any disclaimer, the term of this patent is extended or adjusted under 35 U.S.C. 154(b) by 1067 days.

(21) Appl. No.: 16/770,712

(22) PCT Filed: Dec. 7, 2018

(86) PCT No.: PCT/FI2018/050886
§ 371 (c)(1),
(2) Date: Jun. 8, 2020

(87) PCT Pub. No.: WO2019/110875
PCT Pub. Date: Jun. 13, 2019

(65) Prior Publication Data

US 2021/0002797 A1 Jan. 7, 2021

(30) Foreign Application Priority Data

Dec. 8, 2017 (FI) ..... 20174282

(51) Int. Cl.
*D03D 1/00* (2006.01)
*D02G 3/44* (2006.01)
(Continued)

(52) U.S. Cl.
CPC ..... *D03D 1/0058* (2013.01); *D02G 3/441* (2013.01); *D03D 15/25* (2021.01); *D03D 15/283* (2021.01);
(Continued)

(58) Field of Classification Search
CPC .... D03D 1/0058; D03D 15/283; D03D 15/41; D03D 15/25; D03D 15/37; D02G 3/441; D04B 21/41; D10B 2101/00; D10B 2101/20; D10B 2401/16; D10B 2502/04; D10B 2502/06
(Continued)

(56) References Cited

U.S. PATENT DOCUMENTS

| | | | |
|---|---|---|---|
| 4,793,130 | A | 12/1988 | Togashi et al. |
| 2004/0147193 | A1 | 7/2004 | de Waegheneire |
| 2016/0358690 | A1 | 12/2016 | Liu et al. |

FOREIGN PATENT DOCUMENTS

| | | |
|---|---|---|
| CN | 203280157 | 11/2013 |
| CN | 103074723 | 1/2014 |

(Continued)

OTHER PUBLICATIONS

Office Action issued on Jul. 3, 2020 in corresponding Japanese Application No. 2020-531055 (with translation), 5 pages.

(Continued)

*Primary Examiner* — Camie S Thompson
(74) *Attorney, Agent, or Firm* — Nixon & Vanderhye PC

(57) ABSTRACT

The invention relates to a fabric. The fabric (10) comprises, in the fabric material, threads (11*a*1, 12*a*1; 13*a*1, 14*a*1) of a material conducting electricity well, by means of which electro-magnetic radiation and magnetic fields are filtered. The threads (11*a*1, 12*a*1; 13*a*1, 14*a*1) are placed next to each other. Furthermore, the threads are wound around their winding axes (X1, X2; Y1, Y2) so that the first thread (11*a*1, 13*a*1) in the fabric is wound clockwise, and the second thread (12*a*1, 14*a*1) next to it is wound counterclockwise.

14 Claims, 9 Drawing Sheets

(51) Int. Cl.

| | |
|---|---|
| ***D03D 15/25*** | (2021.01) |
| ***D03D 15/283*** | (2021.01) |
| ***D03D 15/37*** | (2021.01) |
| ***D03D 15/41*** | (2021.01) |
| ***D04B 21/14*** | (2006.01) |

(52) U.S. Cl.
CPC ..... *D03D 15/37* (2021.01); *D03D 15/41* (2021.01); *D04B 21/14* (2013.01); *D10B 2101/00* (2013.01); *D10B 2101/20* (2013.01); *D10B 2401/16* (2013.01); *D10B 2503/04* (2013.01); *D10B 2503/06* (2013.01)

(58) Field of Classification Search
USPC ..... 442/308
See application file for complete search history.

(56) References Cited

FOREIGN PATENT DOCUMENTS

| | | |
|---|---|---|
| CN | 105774084 | 7/2016 |
| CN | 106087171 | 11/2016 |
| FI | 8695 | 4/2010 |
| GB | 840243 | 7/1960 |
| JP | 61-199097 | 12/1986 |
| JP | 11-293532 | 10/1999 |
| JP | 2004-190194 | 7/2004 |
| JP | 2006-124900 | 5/2006 |
| KR | 20-0434635 | 12/2006 |
| KR | 2011-0010527 | 2/2011 |
| WO | 94/19519 | 9/1994 |
| WO | 2007/117883 | 10/2007 |
| WO | 2009-532015 | 9/2009 |
| WO | 2015/001164 | 1/2015 |

OTHER PUBLICATIONS

International Search Report and Written Opinion of the ISA for PCT/FI2018/050886 mailed Mar. 1, 2019, 13 pages.
International Preliminary Report on Patentability for PCT/FI2018/050886 dated Jan. 9, 2020, 15 pages.
Office Action issued in CN 201880079151.7 (dated Mar. 3, 2021) (w/ translation).
Notice of Grant issued on Oct. 24, 2022 in corresponding Korean Application No. 10-2020-7018793 (with partial translation), 4 pages.
Office Action issued on Oct. 5, 2021 in corresponding Korean Application No. 2021-078005212, 13 pages.
Sep. 12, 2023 Office Action issued in European Patent Application No. 18885236.2, pp. 1-8.
Extended European Search Report issued in EP App. No. 18885236.2 dated May 11, 2021.

FABRIC

This application is the U.S. national phase of International Application No. PCT/FI2018/050886 filed Dec. 7, 2018 which designated the U.S. and claims priority to FI Patent Application No. U20174282 filed Dec. 8, 2017, the entire contents of each of which are hereby incorporated by reference.

BACKGROUND OF THE INVENTION

The invention relates to a fabric.

A fabric structure is known from the inventor's previous utility model FI U20100023, which utilizes a separate network structure which is of a material conducting electricity and heat well. By means of the network, electromagnetic radiation is prevented from passing through the fabric. The distance between threads in the network determines the wavelength of electromagnetic radiation that is not allowed to pass through the network structure of the fabric. The network acts as a filter.

SUMMARY OF THE INVENTION

In this new application by the inventor, the fabric comprises a network of electrically conducting, wound, that is, twined thread, which prevents, if the fabric is a piece of clothing, electromagnetic radiation and magnet fields generated by magnets from passing through the fabric to a user of the item of clothing. This way, a protection is achieved for a person against electromagnetic radiation and against the magnet fields produced by magnets. Therefore, a wound network structure of a fabric, formed of graphite thread, for example, acts as a filter of electromagnetic radiations preventing electromagnetic radiation higher than a certain wavelength from passing through the fabric, such as a bed-sheet, to a sleeping person. A wound network also prevents the magnetic field of a magnet from passing through a fabric, such as a piece of clothing, to a person using the fabric.

The thread material of the network also conducts heat well, so by means of the network, in case of a bed-sheet, a sleeping person's heat remaining comfortably low within the sheet is promoted to achieve a good night's sleep.

The electromagnetic radiation is transformed into heat in electrically conducting threads, and the temperature of the fabric increases by several degrees. A piece of health clothing may be produced from the fabric. The person using the piece of clothing stays warm even with less clothes on.

The distance between the threads of the network, that is, grid distance D1, may be 0.5 mm to 50 mm. The threads are of a material that conducts electricity well. The threads may be graphite, silver, or copper, for example. The selection of the grid distance D1 determines the wavelength range that cannot pass through the network.

Long-term stay in a magnetic field causes health risks. Open wires, power lines, electrical devices create electromagnetic fields that may cause biological damages. Moreover, some people are oversensitive to electricity and get a variety of symptoms even when subjected to fields having very low values.

In this application, a new type of fabric or texture or knitted product or similar has been formed. In the invention, the filtering of electromagnetic fields has been improved even further. In the invention, electromagnetic fields are put out as are magnetic fields generated by magnets both those originating from inside a person as well as those coming from the outside towards a person. This takes place by using a beam thread or weft thread in the fabric, which is of a material conducting electricity well. The thread in question is a part of the base material of the fabric so that it is a structural part of the fabric or knitted fabric, for example a part of the texture structure; filament structure.

The thread conducting electricity well may be formed of one or more strands whereby one strand is of a material conducting electricity well while the other strands are support strands wound in the same direction as the strand conducting electricity well.

The thread in question conducting electricity well is wound, so twined/spun into a winding. The first thread is wound clockwise around its winding axis X1, and a second thread of an electrically conductive material next to it is wound counterclockwise around its winding axis X2. The second wound thread of a material conducting electricity well is also wound into a winding and is placed at a distance D1 from the first thread in question. So, adjacent electrically conductive threads are wound into windings around their winding axes X1 and X2 in different directions, one clockwise, the other counterclockwise.

Thus the first thread is wound clockwise and the second thread is wound counterclockwise.

The winding axes X1 and X2 are parallel to each other. Each thread consists of at least one strand of a material conducting electricity well. Advantageously, the thread comprises, in addition to the strand in question, one or more support strands wound in the same winding direction as the strand conducting electricity. The support strands support the thread structure and the strand conducting electricity. Electromagnetic fields and/or magnet fields from the outside towards a person die out, and electromagnetic fields from the person itself, generated by muscular tension, die out. The fabric thus provides an effective protection against all magnetic radiation.

What takes place in the arrangement is that electromagnetic radiation from the inside and outside generate electrical current in the windings, which further generate electromagnetic fields in the wound windings which die out in adjacent strands at each others' threads. The electromagnetic fields of a person's own body, such as muscles, die out, and electromagnetic fields and magnetic fields from the outside towards the person die out. A person who is wearing a piece of clothing made of the fabric of the invention or using a bed-sheet or knitted product made of the inventive fabric achieves a good comprehensive protection against electromagnetic radiation and magnetic radiation. At the location of the person, a space free of electromagnetic radiation and magnetic fields is achieved.

In the electrically conductive threads of the fabric, electromagnetic radiation is transformed into electrical currents and further into heat. A temperature increase takes place in the fabric, and the fabric may be used in thermal clothing. Therefore, the phenomenon referred to in the above may be utilized in the use of the fabrics.

A wound thread may comprise a support strand or a plurality of support strands wound clockwise at a second thread and in the same direction as the electrically conductive strand. They act as a support frame of a spiral-like structure. In the second thread, the support structure is the same, but the winding direction is counterclockwise. The support strands are not electrically conductive. There are advantageously two or three or four or more or them, and in each thread, there is advantageously one electrically conductive strand.

Adjacent thread lines are repeated so that every other thread is wound clockwise, and every other thread is wound counterclockwise. This results in a network structure that provides protection against electromagnetic radiation on the entire length and width of the fabric. The cross section of the electrically conductive strands in the thread is advantageously round, and with the number of winding turns of the electrically conductive strand in the thread per a unit of length, it is possible to adjust the effectiveness of the filtering.

The threads may also have been placed transversely in relation to the winding axes X1 and X2, whereby protection is obtained also in relation to a vibration plane turned by 90 degrees. The arrangement with threads running this way is the same as that of threads in the X1, X2 directions. Adjacent threads are wound alternately in the clockwise and anti-clockwise direction. The distance D1 between the winding axes X1, X2 and X3, X4 is in the range 0.5 mm to 50 mm. A grid G1, G2, G3 . . . Gn bound by the treads is obtained, and an effective protection against electromagnetic radiation.

The third and fourth electrically conductive threads in question each comprises a strand of a material conducting electricity well, as do the first and second threads. The strand may be of silver, graphite or copper, for example, or of another electrically conductive material. When the strands are located on different sides of the fabric or knitted product, they do not touch each other at the crossing points.

They may have been placed as a network on either side of the fabric. This therefore allows an embodiment in which the transversely running threads are located on the same side of the fabric and contact the first and second threads at the crossing points of the threads of the network.

This way, the inventive fabric structure filters and puts out electromagnetic radiation and magnetic fields generated by magnets.

The fabric, texture or knitted product according to the invention are characterised by what is disclosed in the claims.

In the following, the invention is described with reference to preferred embodiments of the drawings, to which the invention is not meant to be exclusively restricted.

DETAILED DESCRIPTION OF THE INVENTION

Figure 1A:
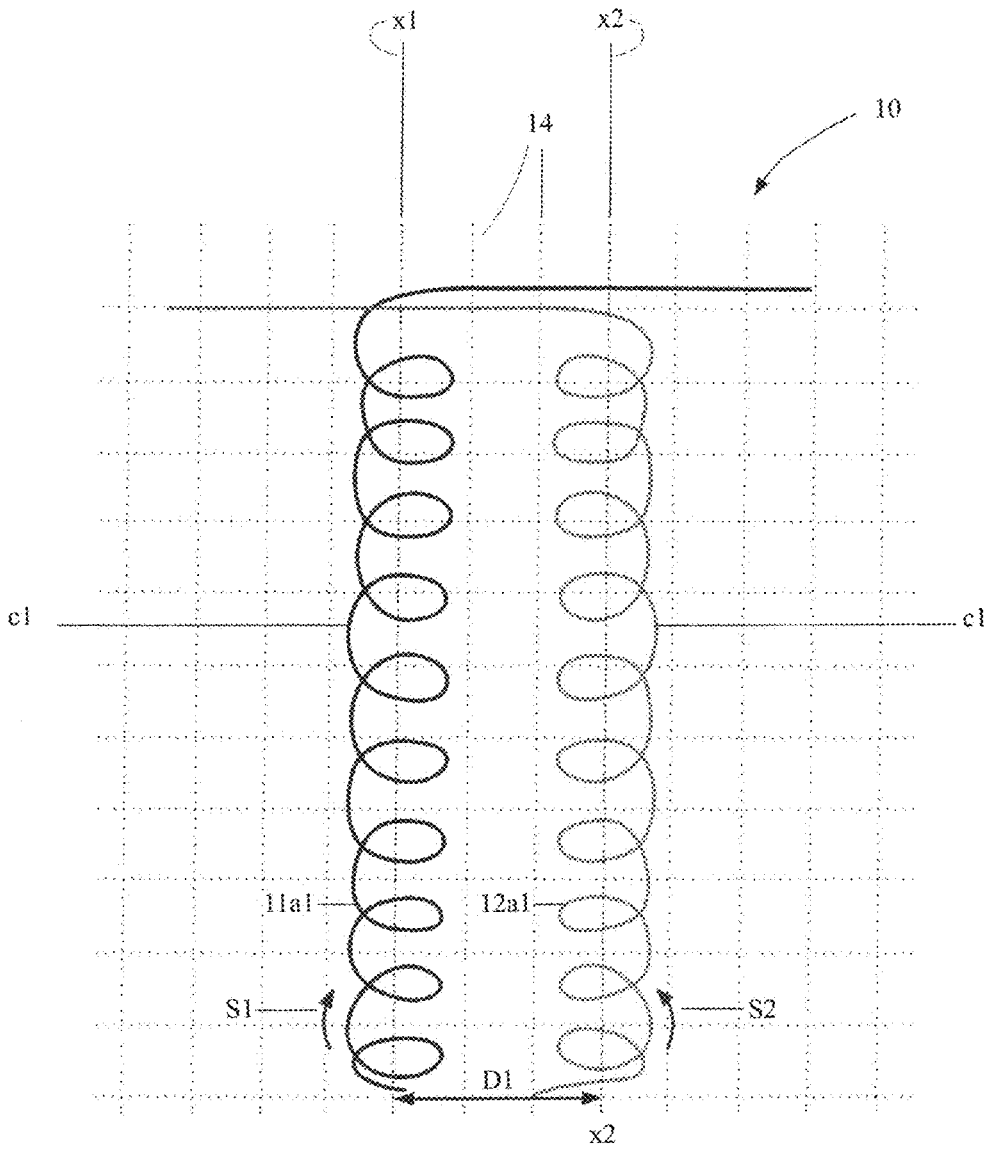
FIG. 1A illustrates a top view of the fabric according to the invention.

FIG. 1A is a schematic representation of a fabric 10 according to the invention. It may also be a knitted product or weft.

The fabric comprises adjacent and parallel electrically conductive threads 11*a*1, 12*a*1; 11*a*2, 12*a*2; 11*a*3, 12*a*3; . . . .

The threads 11*a*1 and 12*a*1 are wound into windings in opposite direction S1 and S2. The winding direction S1 of the thread 11*a*1 around its winding axis X1 is clockwise, and the winding direction S2 of the thread 12*a*1 around its winding axis X2 is counterclockwise.

The fabric, knitted product, or similar, needs to be at a short distance from a person's skin. The fabric may be a piece of clothing, such as a sportswear, a bed-sheet, or a nightgown. The magnetic field produced by a person's muscular tension dies out at the windings of the threads. Likewise, the field of electromagnetic radiation from the outside and magnetic fields of magnets die out. The magnetic fields generate an electric current in the threads, the currents further generating flows of electric currents in opposite direction in adjacent threads, and further electromagnetic fields that further put each other out. According to the invention, the fabric 10 is formed of threads 11*a*1, 12*a*1; 11*a*2, 11*a*2; . . . wound into windings and by weaving or knitting from beam threads 14 or similar, and advantageously by machine weaving/machine knitting automatically. In the winding, with the number of winding turns of the electrically conductive strand c1 per a unit of length, the effectiveness of the filtering is adjusted. As shown in FIG. 1A, the threads extend on the area of the entire fabric, running as per FIG. 1A from the bottom to the top, from the lower edge of the fabric to its top edge. Each thread begins at the bottom edge of the fabric and ends at the top edge. The winding axis X1 and X2 are at a distance D1 from each other. The axes X1 and X2 are parallel and advantageously straight.

In this application, fabric 10 is also understood to refer to a knitted fabric, such as a machine knitted piece of clothing, such as a blouse, bed-sheet etc. Wallpaper, too, is possible.

Figure 1B:
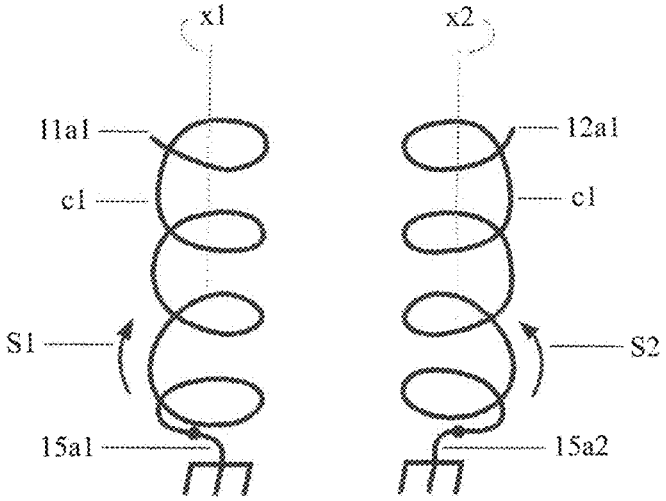
FIG. 1B shows the solution of FIG. 1A, with the exception that each thread comprises a grounding wire.

The solution of FIG. 1B otherwise corresponds with the solution of FIG. 1A, but each thread 11*a*1, 12*a*1, 11*a*2, 12*a*2, 11*a*2, 12*a*3 . . . comprises a grounding wire 15*a*1, 15*a*2, . . . . Grounding provides a major improvement in filtering the fields but is not a must.

Figure 2A:
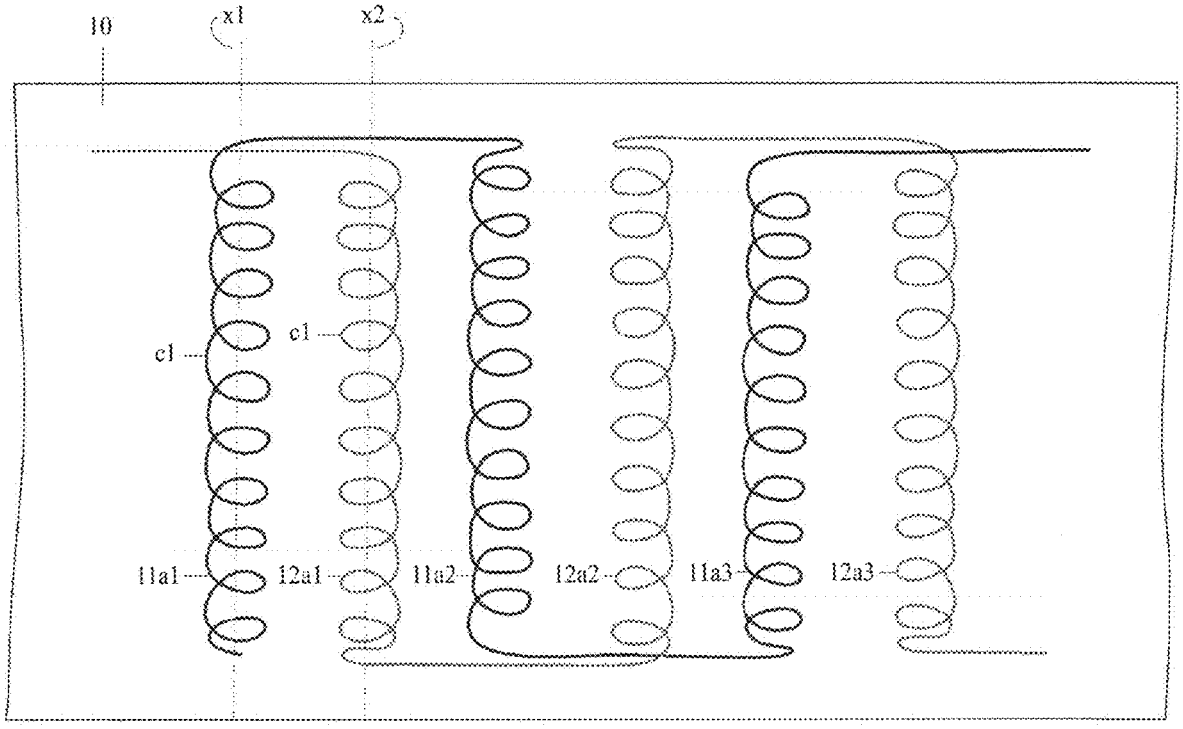
FIG. 2A shows a preferred embodiment of how the electrically conductive threads are passed in a loop-like fashion in the fabric structure.

FIG. 2A is an embodiment of the invention where the thread 11*a*1 has been passed in a loop-like, wavelike fashion, and likewise the thread 12*a*1 has been passed in a loop-like and wavelike fashion. They have been passed as open loops so that the threads have been placed in relation to each other so that next to the thread 11*a*1 there is always the thread 12*a*1, in other words, next to the thread 11*a*1 wound clockwise, there is always the thread 12*a*1 wound counterclockwise.

Figure 2B:
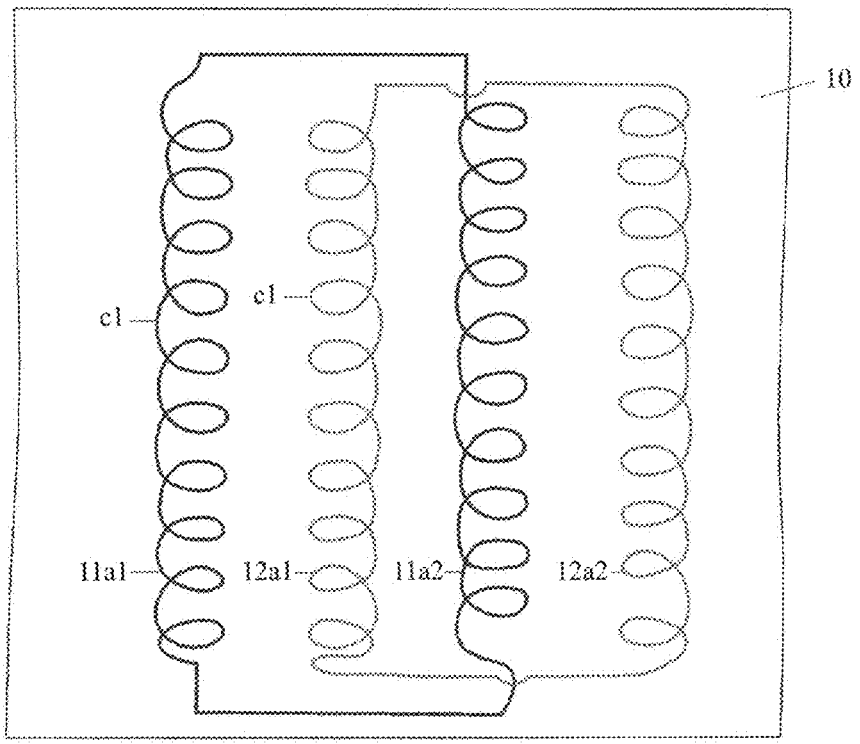
FIG. 2B shows a solution according to FIG. 2A, with the exception that the thread passes are not closed.

FIG. 2B show the solution of FIG. 2A, except that the electrically conductive threads 11*a*1, 12*a*1 are closed loops.

Figure 2C:
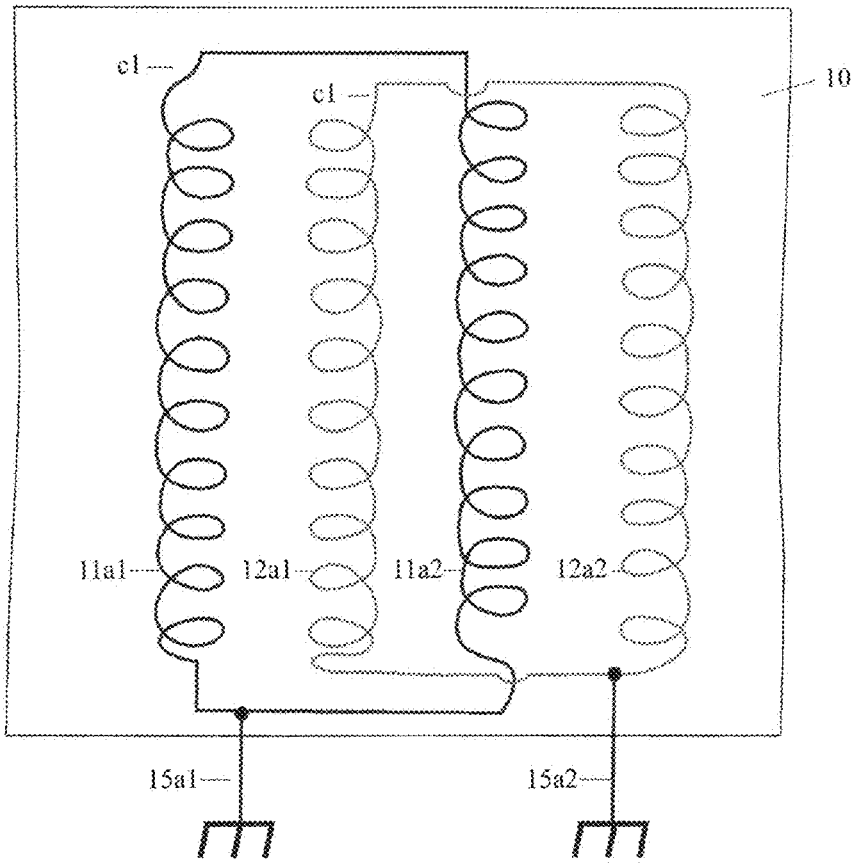
FIG. 2C shows the solution of FIG. 2B, also comprising grounding of the loops.

In FIG. 2C, the threads and closed loops 11*a*1 and 12*a*1 of the embodiment of FIG. 2B are grounded by wires, or in general by electrically conductive threads 15*a*1, 15*a*2.

Figure 3:
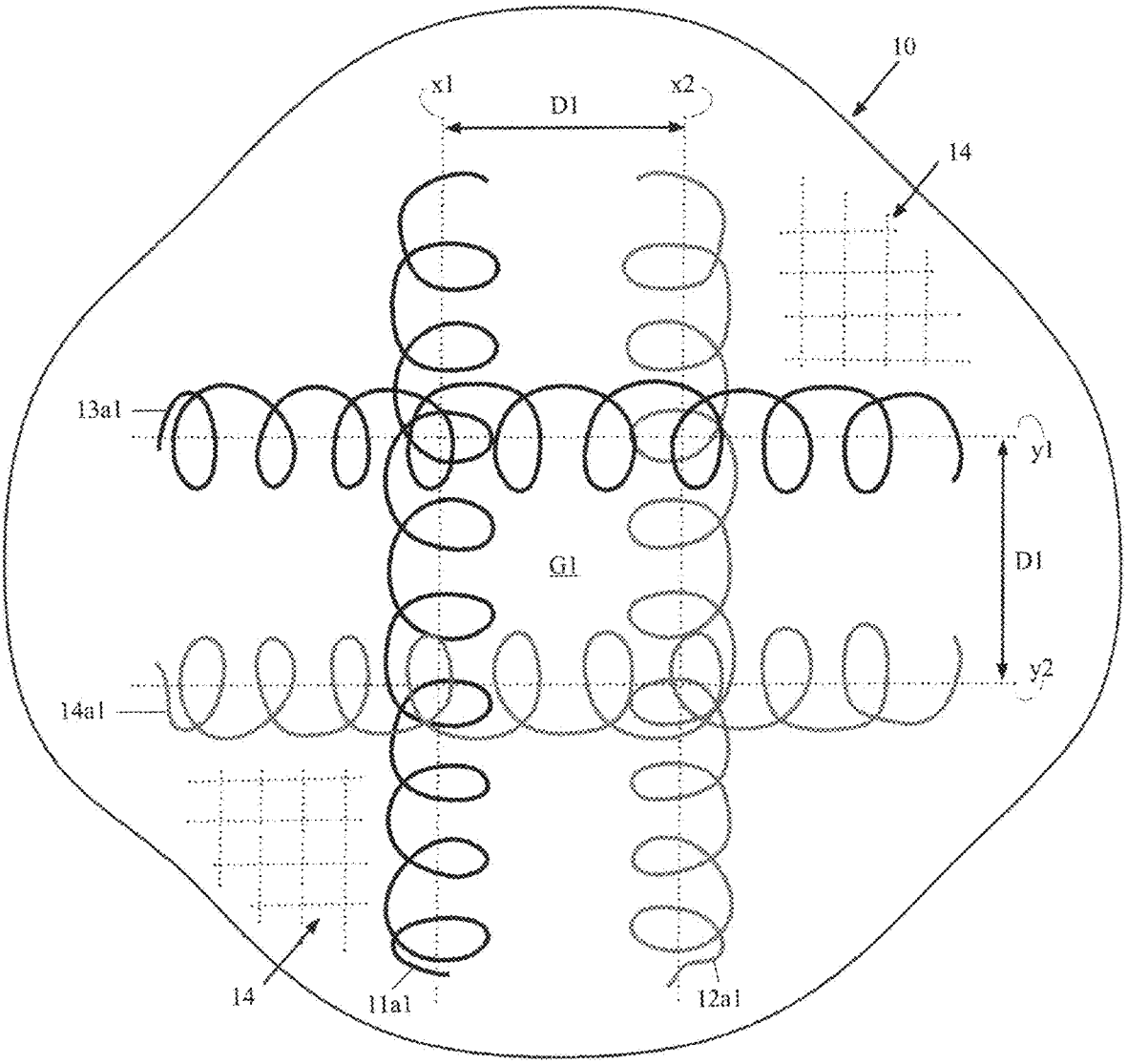
FIG. 3 shows the placing of threads in the Y direction transversely in relation to the X direction, the treads defining rectangular or square areas.

FIG. 3 shows an embodiment of the invention, where there are, in addition to the vertical threads 11*a*1, 12*a*1, also horizontal threads 13*a*1, 14*a*1 which have been placed and wound following the same principle as the threads 11*a*1, 12*a*1 of FIG. 1A.

The threads 13*a*1, 14*a*1 are so wound that the threads 13*a*1 are wound around their horizontal winding axis Y1 clockwise, and the threads 14*a*1 are wound around their winding axis Y2 counterclockwise. The axes Y1 and Y2 are horizontal straight axes parallel in relation to each other. The distance between them is D1. Therefore, by winding, the threads 13*a*1, 14*a*1 are formed into windings. The magnetic fields they generate put each other out and affect radiation turned by 90 degrees. This way, electromagnetic radiations on different planes are effectively put out by the solution. In this solution, too, the threads 13*a*1, 14*a*1 of a material conducting electricity well are so arranged in relation to each other that a thread wound clockwise is next to a thread wound counterclockwise.

Figure 4:
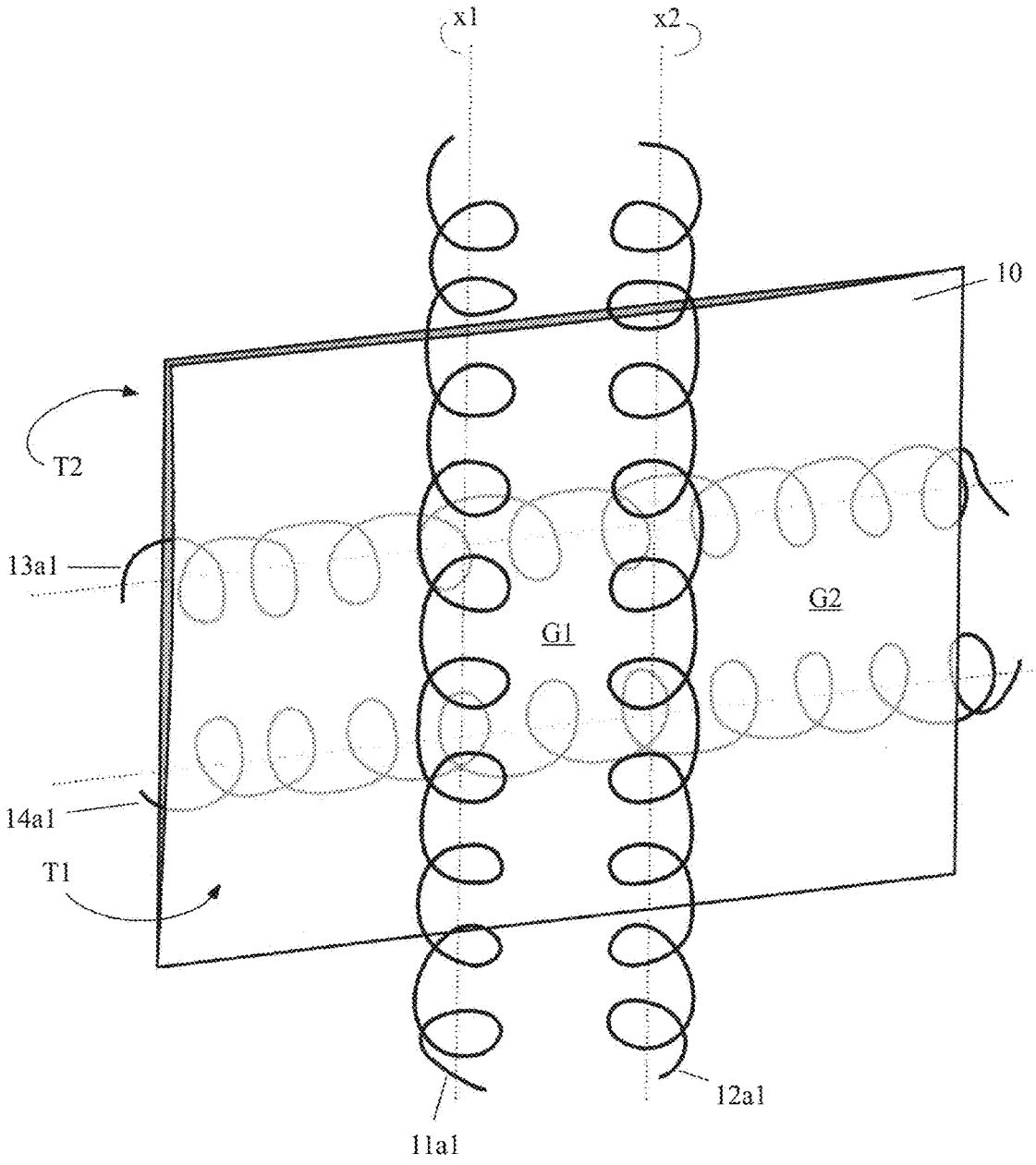
FIG. 4 illustrates the placing of threads in the Y direction on one side of the fabric, whereas threads in the X direction are on the other side of the fabric.

FIG. 4 illustrates the solution of FIG. 3. The threads 11*a*1,12*a*1;13*a*1,14*a*1 are located on the surface of the fabric, and on the side T1 contact each other at the crossing points in the embodiment. The network is attached to the fabric. It is part of the beam thread and weft structure of the fabric. The network forms a grid G1, G2, G3 . . . .

Figure 5:
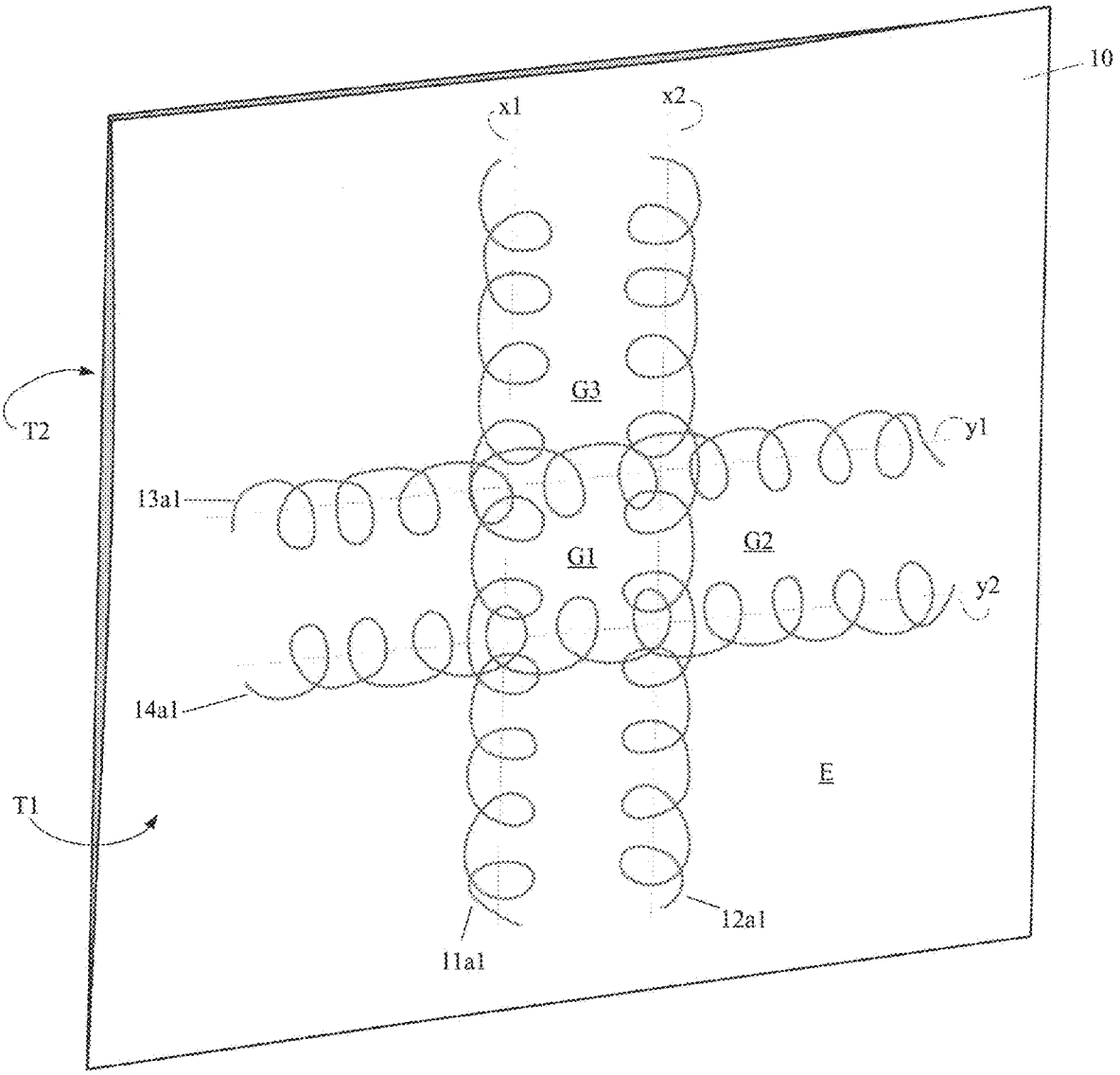
In FIG. 5, the threads in the X direction and Y direction cross each other.

In FIG. 5, the thread 13*a*1, 14*a*1 are located on the fabric structure side T2 and the structure formed by the threads 11*a*1, 12*a*1 on the other side T1 of the fabric structure. Together they form a network structure when the plane fabric is examined in the direction of the normal of its plane E.

Figure 6:
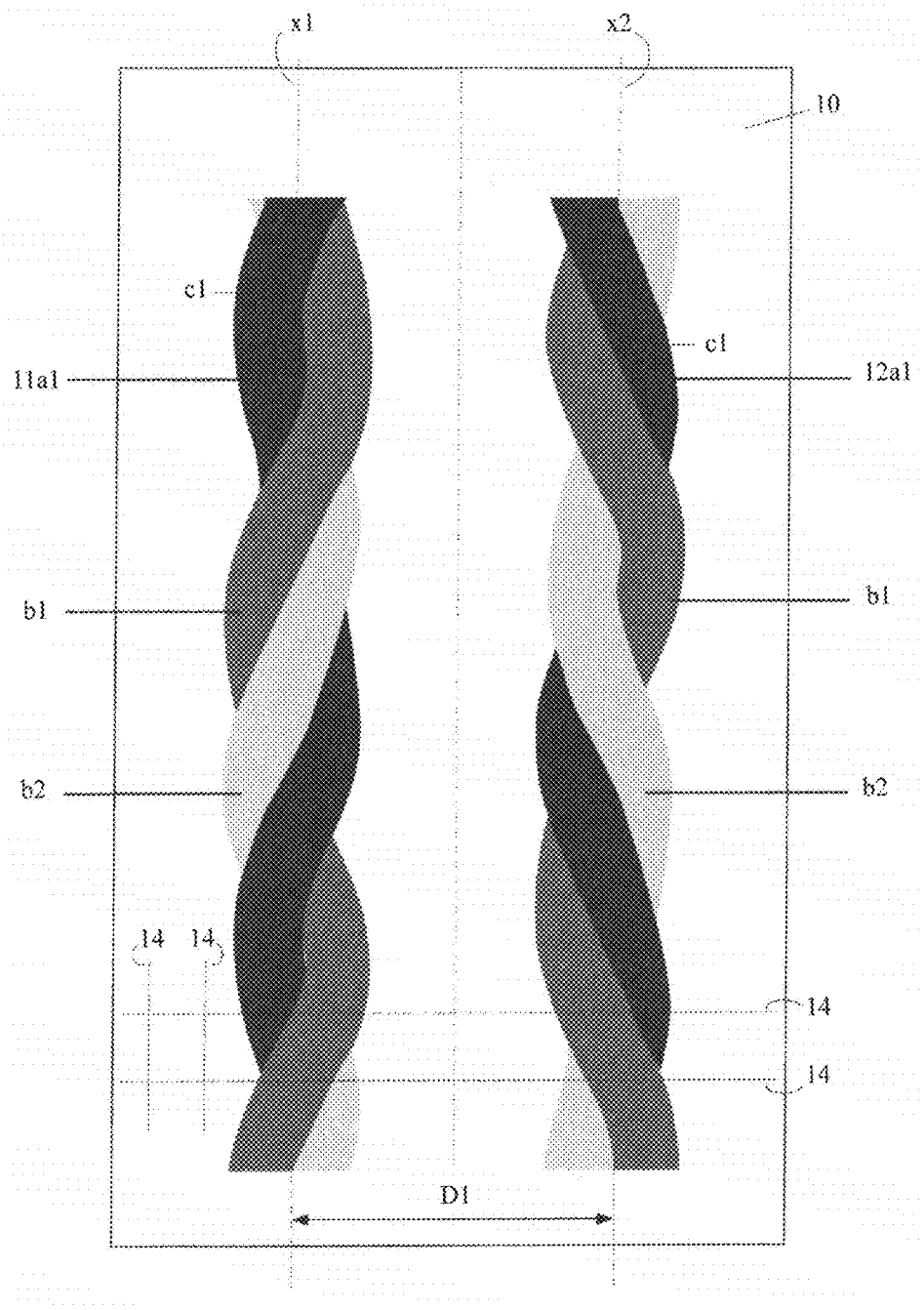
FIG. 6 shows how the electrically conductive strands are supported by non-conductive support strands wound in the same direction.

FIG. 6 shows a solution where the thread 11*a*1 is formed so that it comprises at least one strand c1 wound from a material conducting electricity well and support strands b1, b2 wound in the same winding direction, and which are not of a material conducting electricity. The purpose of the support strands b1, b2 is to support the thread structure. The support strands b1, b2 may also keep the temperature under control, that is, they may be thermally limiting fibres. The support strands may be polyester fibres, for example. There may be a plurality of channels in the structure of the support strands.

The strands c1, b1, b2 are mutually wound in the same direction, clockwise in the embodiment of the figure.

The structure is similar at the strand 12*a*1. It, too, comprises the strand c1 of a material conducting electricity well and support strands b1, b2 that are not of a material conducting electricity. They are mutually wound in the same direction, counterclockwise in the embodiment of FIG. 6. Adjacent threads 11*a*1, 12*a*1 have mutually different winding directions. One thread 11*a*1 is wound clockwise and the other thread 12*a*1 anticlockwise.

The thread 11*a*1,12*a*1,13*a*1,14*a*1 may in an embodiment be formed of just one strands c1 of a material conducting electricity well, in which embodiment there are no support strands.

The cross section of the strands c1 conducting electricity and the supports strands b1, b2 of the threads is advantageously round. The cross section is perpendicular along the longitudinal and centre axis of the strand. The cross sectional dimension of the threads 11*a*1,12*a*1,13*a*1,14*a*1 is less than 3 mm and advantageously less than 1 mm.

Other cross sectional forms are also possible. A person skilled in the art will find it obvious that, as technology advances, the basic idea of the invention may be implemented in many different ways. The invention and its embodiments are thus not restricted to the examples described above but may vary within the scope of the claims.

The invention claimed is:

1. A fabric comprising, in the fabric material, threads of a material conducting electricity well, by means of which electromagnetic radiation and magnetic fields are filtered, wherein the threads are placed next to each other and wound around their winding axis so that in the fabric the first thread is wound clockwise around a first winding axis thereby forming a first winding and the second thread next to it is wound counterclockwise around a second winding axis thereby forming a second winding, wherein the first winding and second winding put out magnetic field and wherein the first winding axis is at a distance from the second winding axis, and the threads comprise a material that conducts electricity well.

2. A fabric as claimed in claim 1, wherein the winding axes of the first thread and the second thread are parallel and at a distance from each other, which is 0.5 mm to 50 mm.

3. A fabric as claimed in claim 1, wherein the first thread is passed as a closed loop or open loop, the first thread being wound around the first winding axis such that, when viewed in plan view, the first thread appears to have first peaks separated by first troughs where the first peaks are provided on a first side of the first winding axis and the first troughs are provided on a second side of the first winding axis opposite to the first side of the first winding axis, and wherein the second thread is also passed as a closed or open loop so that adjacent threads are oppositely wound, one wound clockwise in relation to its winding axis, and the other counterclockwise in relation to its winding axis, the second thread being wound around the second winding axis such that, when viewed in plan view, the second thread appears to have second peaks separated by second troughs where the second peaks are provided on a first side of the second winding axis and the second troughs are provided on a second side of the second winding axis opposite to the first side of the second winding axis.

4. A fabric as claimed in claim 1, wherein the first and second threads are oriented vertically with respect to the fabric, wherein the fabric comprises, in connection with or near the first and second threads, additional threads that run horizontally with respect to the fabric, and wherein the first and second threads and the additional threads form a grid.

5. A fabric as claimed in claim 4, wherein third and fourth threads are also placed next to each other so that the third threads are wound clockwise and the fourth threads are wound counterclockwise, and next to the thread wound clockwise there is the thread wound counterclockwise.

6. A fabric as claimed in claim 5, wherein the distance between horizontal winding axes is 0.5 mm to 50 mm.

7. A fabric as claimed in claim 4, wherein the grid formed by the threads is located on the surface of the fabric or in the middle of it.

8. A fabric as claimed in claim 4, wherein the vertical threads are located on one surface of the fabric and wherein the horizontally running threads are located on the other surface of the fabric.

9. A fabric as claimed in claim 1, wherein the fabric comprises a grounding wire connected to the electrically conducting thread.

10. A fabric as claimed in claim 1, wherein the electrically conducting thread comprises copper, silver, or graphite, or another material conducting electricity.

11. A fabric as claimed in claim 1, wherein the fabric is a woven fabric, knitted fabric, bed-sheet, piece of clothing, or wallpaper made of threads.

12. A fabric as claimed in claim 1, wherein the electrically conducting thread consists of at least one strand of a material conducting electricity well and of at least one support strand which is not of a material conducting electricity well, and wherein in the same thread, the strand of a conductive material and the support strand are wound in the same winding direction in the same thread.

13. A fabric as claimed in claim 12, wherein the cross sectional form of the electrically conductive strand is round.

14. A fabric as claimed in claim 1, wherein the thread consists of at least one strand of a material conducting electricity well.

* * * * *